US010045575B2

(12) United States Patent
Whyte

(10) Patent No.: US 10,045,575 B2
(45) Date of Patent: Aug. 14, 2018

(54) TRANSFORMABLE ARM-WARE FOR RECREATIONAL ACTIVITIES

(71) Applicant: Camilo Arturo Whyte, Clermont, FL (US)

(72) Inventor: Camilo Arturo Whyte, Clermont, FL (US)

( * ) Notice: Subject to any disclaimer, the term of this patent is extended or adjusted under 35 U.S.C. 154(b) by 0 days.

(21) Appl. No.: 15/013,801

(22) Filed: Feb. 2, 2016

(65) Prior Publication Data

US 2017/0215500 A1 Aug. 3, 2017

(51) Int. Cl.

*A41D 27/10* (2006.01)
*A41D 27/08* (2006.01)
*A41D 27/00* (2006.01)

(52) U.S. Cl.

CPC ..... *A41D 27/10* (2013.01); *A41D 27/08* (2013.01)

(58) Field of Classification Search

CPC ..... G08B 5/02; G09F 21/02; G09F 17/00; A41D 13/0015; A41D 19/0024; A41D 27/08; A41D 27/10; A47G 9/1045; A63J 7/005

See application file for complete search history.

(56) References Cited

U.S. PATENT DOCUMENTS 1,670,176 A * 5/1928 Woolery ..... G08B 5/02 116/173
2,067,423 A * 1/1937 Sohn ..... B64D 17/78 244/138 R
2,213,754 A * 9/1940 Thirring ..... A41D 13/00 2/88
2,223,029 A * 11/1940 Dunton ..... A41D 19/0024 150/117
2,534,313 A * 12/1950 Starkey ..... G08B 5/02 116/200
2,647,261 A * 8/1953 Rassner ..... A41D 1/04 2/115
4,220,299 A * 9/1980 Motter ..... B64D 10/00 2/250
4,277,848 A * 7/1981 Boehland ..... A41D 1/04 2/115
4,296,498 A * 10/1981 Vinson ..... A41D 1/04 2/115
4,369,215 A * 1/1983 Offen ..... D04D 7/06 28/147
4,466,136 A * 8/1984 Bottom ..... A41D 1/04 2/1
4,670,909 A * 6/1987 Forrester ..... A41D 19/002 2/160
4,710,981 A * 12/1987 Sanchez ..... A41D 27/08 2/115
4,727,822 A * 3/1988 Wikkerink ..... G09F 17/00 116/174
4,752,971 A * 6/1988 Meserol ..... A41D 3/08 2/84
4,850,052 A * 7/1989 Matthews ..... A41D 19/0024 2/160

(Continued)

*Primary Examiner* — Bobby Muromoto, Jr.

(57) ABSTRACT

An accessory for cheering in sports or other entertainment and outdoor activities, such as a new and improved arm-ware assembly which can be mounted on an individual's arm and wrist so as not to restrict an individual's hands/arm in cheerleading or similar recreational activities. The arm-ware assembly is made of flexible material and is washable and reusable and is multifunctional.

8 Claims, 3 Drawing Sheets

(56) References Cited

U.S. PATENT DOCUMENTS 4,884,768 A * 12/1989 Ansley ..... B64D 17/00 2/79
4,999,848 A * 3/1991 Oney ..... A41D 1/04 2/115
5,176,600 A * 1/1993 Wilkinson ..... A41D 13/0015 482/105
5,222,259 A * 6/1993 Bristor ..... A41D 13/0015 2/108
5,329,873 A * 7/1994 Tiballi ..... A45B 9/00 116/173
5,361,523 A * 11/1994 Robinson ..... G09F 21/02 2/95
5,379,461 A * 1/1995 Wilmers ..... A41D 27/08 2/115
5,400,437 A * 3/1995 Koutras ..... A41D 15/04 116/173
6,065,416 A * 5/2000 Araeen ..... B63B 35/7973 114/102.11
6,067,660 A * 5/2000 Contini ..... A41D 27/08 2/115
6,401,249 B2 * 6/2002 Haar ..... A41D 11/00 2/69
6,405,381 B1 * 6/2002 Bowman, Jr. ..... A41D 19/0051 2/159
6,820,281 B2 * 11/2004 Mariland ..... A41D 27/20 2/115
7,131,156 B1 * 11/2006 Walker-Craft ..... A47G 9/1045 5/639
7,251,838 B1 * 8/2007 Rumbaugh ..... A41D 19/0024 2/159
7,520,074 B1 * 4/2009 Vanova ..... G09F 21/02 116/173
7,677,194 B2 * 3/2010 Lanh ..... G09F 17/00 116/173
D634,899 S * 3/2011 Myers ..... D29/120.1
8,146,784 B1 * 4/2012 Calanca ..... A47F 7/19 211/85.3
8,695,117 B1 * 4/2014 Machuca ..... A41D 13/0015 2/69
8,832,868 B2 * 9/2014 Owen ..... A41D 27/08 2/244
8,857,632 B2 * 10/2014 Anderson ..... A47F 7/22 211/105.1
9,371,118 B2 * 6/2016 King ..... B63C 9/00
D769,773 S * 10/2016 Reaux ..... D11/174
2004/0133967 A1 * 7/2004 West ..... A41D 27/20 2/247
2004/0221362 A1 * 11/2004 Bosne ..... A41D 3/00 2/93
2007/0101922 A1 * 5/2007 Kengerski ..... G09F 17/00 116/28 R
2007/0169682 A1 * 7/2007 Boyd ..... G09F 3/005 116/173
2008/0092797 A1 * 4/2008 Lanh ..... G09F 21/02 116/173
2008/0092798 A1 * 4/2008 Lanh ..... G09F 21/02 116/173
2009/0120349 A1 * 5/2009 Vanova ..... G09F 21/02 116/173
2009/0280715 A1 * 11/2009 Palmeiri ..... A63J 7/005 446/28
2009/0298378 A1 * 12/2009 Segal ..... A63J 7/005 446/26
2011/0173735 A1 * 7/2011 Polanish ..... A41D 13/0015 2/69
2013/0171906 A1 * 7/2013 Smoot ..... A47G 9/0207 446/73
2013/0298300 A1 * 11/2013 Schaeper ..... A41D 11/00 2/67
2014/0325739 A1 * 11/2014 Miller ..... A41D 19/0024 2/160
2016/0220920 A1 * 8/2016 Dietrick ..... A63J 7/005

* cited by examiner

PATENT
51

50

26
27
60

Fig. 6
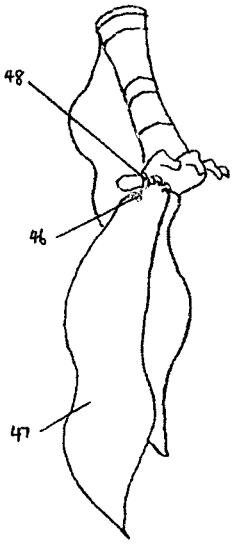
Fig. 7
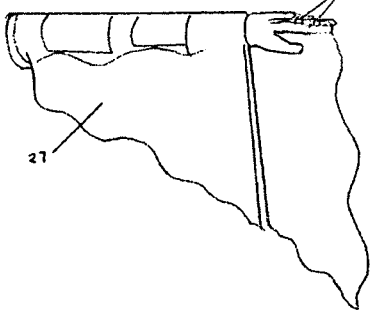
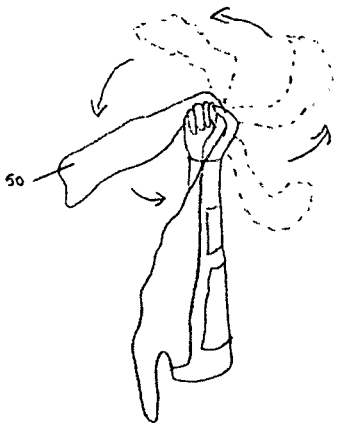
Fig 8
Fig 9
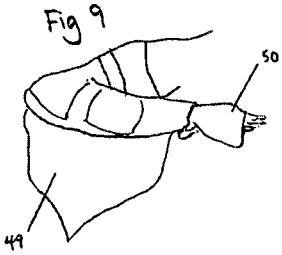
Fig. 10
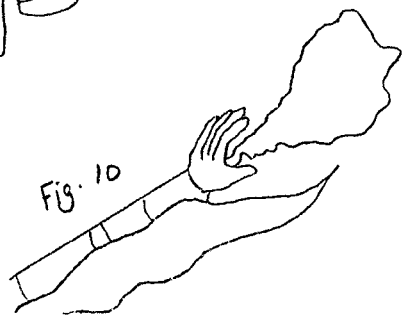

TRANSFORMABLE ARM-WARE FOR RECREATIONAL ACTIVITIES

TECHNICAL FIELD OF THE INVENTION

The present invention relates to sport and fashion accessories and entertainment devices, more particularly to a transformable arm-wear for outdoor activities which relates to a new and improved arm-ware assembly mounted on an individual's arm and wrist so as not to restrict an individual's hands/arm in a cheerleading or similar recreational activities.

BACKGROUND OF THE INVENTION

For cheering activities in sports, various accessories are frequently used. The accessories are usually ascribed as pompons. Amongst the various pompoms in vogue, common ones are the hand-held pompom accessories. However, most of such pompoms have either the disadvantage of restricting the freedom of movements of the hands/wrists or utilizing a specific portion of the hand, e.g., hands, fingers, etc. Besides, most of these cannot be attached to any other body part apart from the increased probability of the users to leave them behind after the event is over. Some of the previous inventions on similar lines are given below U.S. Pat. No. 5,234,725 discloses a wrist pompon structure. The basic idea of this invention is an elastomeric tubular sleeve having a forward annular end wherein annular arrays of elongated, flexible tassel webs are secured. The advantage of this invention is that the cheerleader does not need to hold the pompon in her hand. However this invention does not allow the use of pompons of different structures and for different purposes as well.

With respect to developing a self-securing pompon, as portrayed in quite a number of inventions, the basic structure consists of a loop to enable it placed through the body, thus securing to a person. Such a way of securing the pompom to various body parts, e.g., finger, hand or ankle allows a user to put the body part through the loop. A disadvantage of such a securing is that the loop of the pompom may become loose thus, forcing the holder to hold the pompon loop with her hand to ensure its stability. Moreover, the invention only talks about the usage of pompoms for cheering in sports and similar such events.

The U.S. Pat. No. 7,251,838 B1 discloses a cheering system that allows the wearer of the cheering devices to selectively couple various types of pompoms or cheering devices to a plurality of fingers in such a manner so that the person's hands gets free for gripping other items, or clapping, performing stunts or for other purposes. However, the invention utilizes only the fingers for cheering activities with the other portions of the arm not utilized for cheering activities. This restricts a plethora of cheering activities that could have been undertaken by enabling various movements of the arms.

SUMMARY OF THE INVENTION

To overcome the disadvantages of the prior art and to provide for a more flexible, transformable cheerleading and other recreational activities, the present invention provides for a polyester based transformable arm-ware comprising of a tubular sleeve which is provided with two wings, a first wing and a second wing where the first wing can be used for ornamental functions and the second wing can be transformed into a variety of forms and used for multifunctional recreational outdoor/indoor activities.

OBJECTS OF THE PRESENT INVENTION

It is therefore an object of the present invention to develop a polyester tubular sleeve which has all the advantages of the prior art cheerleading apparatus and none of the disadvantages.

An object of the present invention is to allow the user freedom of movement of the entire arm by keeping the hands free of holding the pompoms, if required.

A still further object of the invention is that the material used is durable apart from being washable thus, being long lasting and be used over years for different entertaining purposes.

Still another object of the present invention is that the arm-ware attachment does not become loose even after repeated use thus increasing its longevity.

Further object of the present invention is that loosing of the pompoms in the event is minimized since fans will not put pompons down and forget them when the event is over.

A still another object of the invention is that the sleeve arm-ware according to the present disclosure is multifunctional. It can be used for a number of purposes like performing various motions like yoyo, swirling apart from generating typical sounds for a typical sport-moment through typical pre-defined hand movements.

It is still another object of the present invention to provide a tubular sleeve ware that can be easily and efficiently manufactured and marketed.

It is a further object of the present invention to provide a durable tubular sleeve ware with a reliable construction.

An even further object of the present invention is to provide a new and improved tubular sleeve ware with a low cost of manufacture to ensure its economic viability to the buying public.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7. is a side perspective view depicting another embodiment of the present invention depicting, the additional loops to be used differently and for different purposes.

FIG. 8 is another embodiment of the present invention depicting a swirling motion.

FIG. 9 is a front perspective view of another embodiment of the present invention depicting the wave form of first wing which can also be shaped as continents, countries, clubs' or schools badges and can be used for the display of logos or flags of different countries.

FIG. 10 is another embodiment of the present depicting use of the first and second wing as an ornament for yoyo dance effect.

DESCRIPTION OF THE PREFERRED EMBODIMENT

With reference now to the drawings, and in particular to FIGS. 1 to 12 thereof, a new and improved transformable arm ware embodying the principles and concepts of the present invention will be described.

Figure 1:
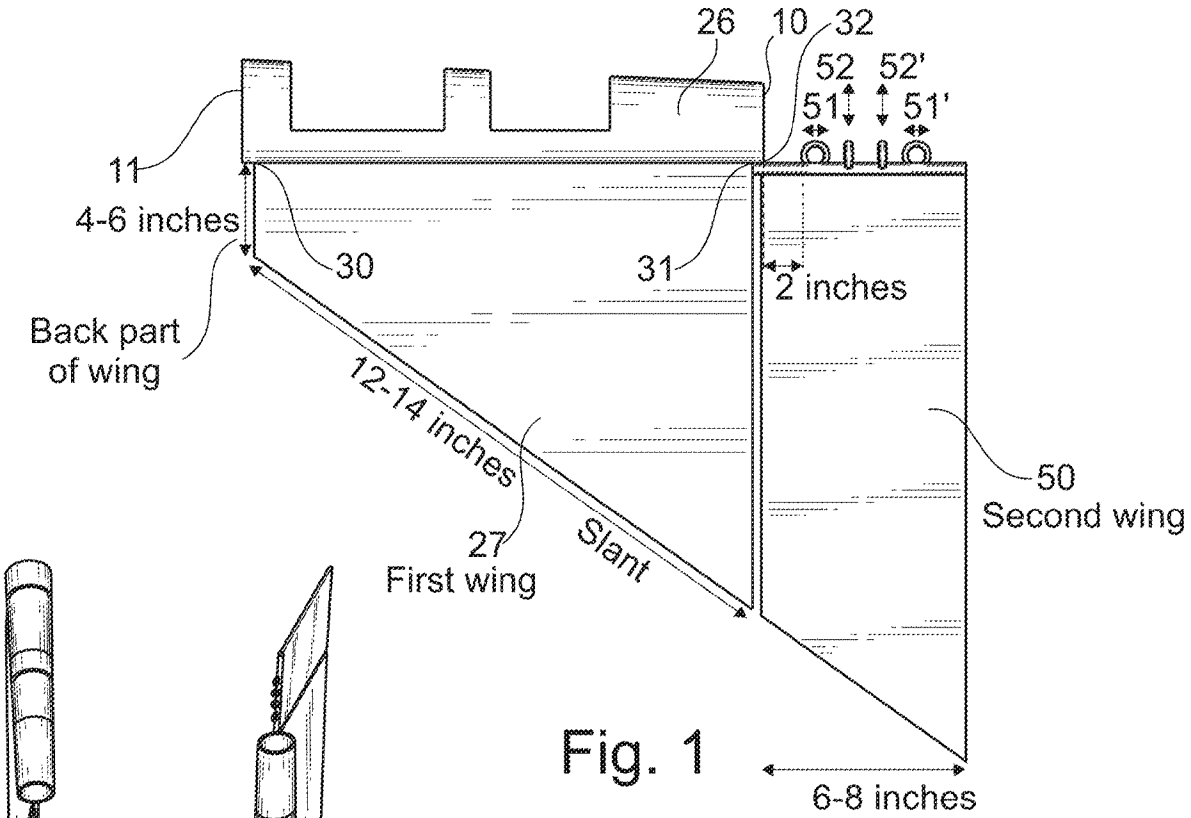
FIG. 1 is a perspective view of the present invention.
Figure 4:
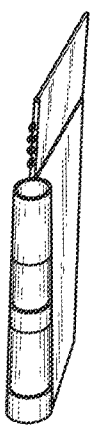
FIG. 4 is front side perspective view of the present invention.
Figure 3:
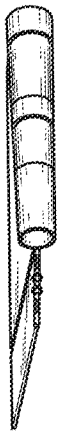
FIG. 3 is a top perspective view of the present invention.
Figure 2:
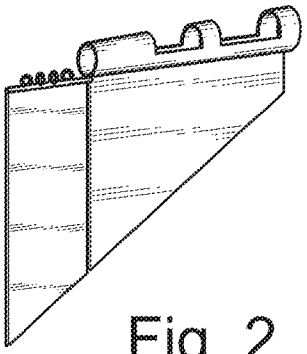
FIG. 2 is a front left hand side perspective view of the present invention.
Figures 5, 11, 12:
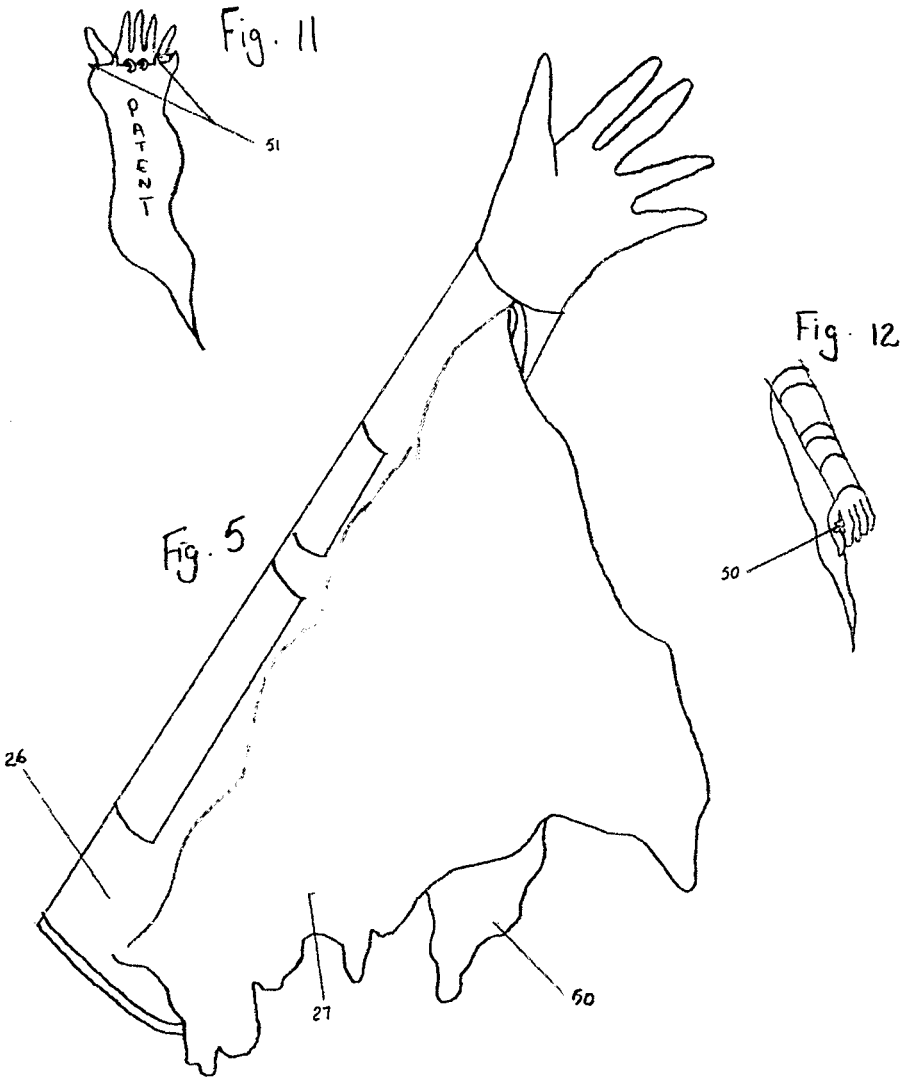
FIG. 5 is an enlarged view of the present invention depicting the first wing, second wing and the arm wear FIG. 6. is a view of another embodiment of the present invention depicting dangling dance.
FIG. 11 is a detailed view of the attachment of the loops (51, 51') and (52, 52') with specific fingers of the user in the present invention.
FIG. 12 is a side top perspective view of the present invention.

Referring to FIG. 1, the transformable arm ware (20) of the present invention essentially is a tubular sleeve (26) made of polyester that is partially open either on top or near the sides and having forward end (10) near the wrist and a rear end (11) near the upper arm.

In the under-arm portion of the tubular sleeve (26) are provisions for attachments of two colourful cloths in the form of wings, a first wing (27) and a second wing (50) wherein, the means of attachments ranges from stitching, snap buttons, zipper, sticking strips as the case may be.

Regarding positioning of the two attached said wings (27) and (50), the said first hanging wing (27) is of a trapezoidal shape under the fore-arm, while the said second wing (50) is hung near the wrist area extending further till fingers where these are connected with the fingers vide four loops, the first loop (51), the second loop (52), the third loop (52') and the fourth loop (51') wherein, the said first and fourth loops (51, 51') are placed parallel to the tubular sleeve (26) and the said second and third loops (52, 52') are placed opposite to the tubular sleeve (26). The loops enable the second wing to rotate and revolve in effectuation of various effects as desired by the user.

The second wing (50) is secured by sewing to (26) at the said forward end (10) of the tubular sleeve (26) near the wrist. Whereas the rest of the portion of the hanging second wing (50) is free and not secured to the lower part of the said first wing (27).

The material used for the tubular sleeve (26) of arm ware (20) is 95% polyester and 5% spandex and that of the first wing (27) and second wing (50) is 100% polyester.

Referring further to FIG. 1, the loops (51, 51') and (52, 52') provided, are for the insertion of the fingers of the user, thereby transforming the said second wing (50) into ornamental formations through various shapes for use as an entertainment element for different activities which is depicted in FIGS. 5 to 10 and 12.

The transformable arm wear (20) structure will now be described in detail with reference further to FIG. 1.

The tubular sleeve (26) is 14-16 inches long extending from the forward end near the wrist (10) till the rear end near the upper arm.

The said first wing (27), positioned below the arm is 12-14 inches in width being secured from the upper end (30) to the lower end of the sleeve (31) but has a difference in height at the two different ends namely forward end near the wrist and the rear end near the upper arm.

The heights respectively being 4-8 inches near the rear end of the tubular sleeve (26) and around 10 to 13 inches long near the forward end of the tubular sleeve (26). The ornamental wing (27) therein forms the shape of a trapezoid.

The said second wing (50) of the sleeve structure also shaped as a trapezoid is 11 to 14 inches in height under the wrist near the first wing (27) and about 14 to 18 inches in height below the fingers. The width of the second wing (50) is 6-8 inches. Further the second wing (50) is secured is secure at a single point (32) as shown in FIG. 1, leaving the entire wing free and dangling near the first wing (27).

The said four loops (51, 51') and (52, 52') are sewn very closely to one another on the said second wing (50) with the closest (51) 2 inches away from the forward end (10) near the wrist area of the tubular sleeve (26).

The said four loops (51, 51') and (52, 52') are stitched for easy insertion of the fingers for different performing actions like cheerleading performances, dabbing dance, yoyo effect etc.

In another embodiment of the present invention and referring to FIG. 1, the tubular sleeve (26) of the said transformable arm-ware (20) has ornamented openings at right side, left side and/or on top portion of arm ware shaped in different eye-catching patterns or styles allowing the user to exhibit their tattoos engraved on the forearm.

In another embodiment of the present invention and referring to FIG. 1, the said tubular sleeve (26) of the said transformable arm-ware (20) may be fully covered, thus hiding the entire bare forearm along with the tattoos of the user.

Regarding embodiments of the first wing (27) and second wing (50) a variety of ways for different effects and in various forms as shown in FIG. 6 to FIG. 10 can be instituted.

In one embodiment of the present invention and referring to FIG. 1, attachment of the wings with the tubular sleeve (26) can be of a wavy format vide wave stitching (22). Besides, the lower end of the trapezoidal wings can also be of a wavy design.

In another embodiment of the present invention as referred in FIG. 6, there are additional fittings or loops (48), on the said second wing (50) varying from 4-8, and is interchangeable wherein the said fittings is fitted to any of the user's fingers/thumb (46) and the second wing (50) is used for various purposes (47) and the user reveals, displays or shows either side of second wing (50) as depicted in FIG. 6.

In still another embodiment of the present invention and referred to in FIG. 8, the said dangling second wing (50) can also be held in the hand and can be given a swirling motion.

In another embodiment of the present invention and referring to FIG. 9, the said first wing (27) can be given different shapes, besides the mentioned trapezoidal one, so as to depict various forms as that of badges or logos, countries, continents, cities, states etc. while executing different dabbing dances.

In still another embodiment of the present invention and referring to FIG. 10, the said second wing (50) as well as the said first wing (27) is used as an ornament for yoyo dance effect. Accordingly, the afore-described embodiment is intended for the purpose of illustration and not as limitation.

What is claimed is:

1. A transformable arm-ware (20) for recreational activities wherein the said arm-ware (20) comprises of a tubular sleeve (26), a first wing (27) and a second wing (50), wherein the said tubular sleeve (26) has a forward end (10) near the wrist area and a rear end (11) near the upper arm, wherein the said first wing (27) is of a trapezoidal shape under the arm, and the said second wing (50) is hung near the wrist area (32) extending further till fingers, wherein the second wing (50) is attached to the fingers by means of four loops, a first loop (51), a second loop (52), a third loop (52') and a fourth loop (51') that individually encompass said fingers.

2. The transformable arm-ware (20) as claimed in claim 1, characterized in that the said first wing (27) is connected with the said tubular sleeve (26), under the fore arm, by attachment means of stitching, snap buttons, zipper, sticking strips.

3. The transformable arm-ware (20) as claimed in claim 1, characterized in that, the said first and fourth loops (51, 51') are placed parallel to the said tubular sleeve (26) and the said second and third loops (52, 52') are placed opposite to the tubular sleeve (26).

4. The transformable arm-ware (20) as claimed in claim 1, characterized in that, the said second wing (50) is secured with the said first wing (27) only at a single point (32) of the arm-ware (20) near the wrist area of the tubular sleeve (26) leaving the entire wing free and dangling near the first wing (27).

5. The transformable arm-ware (20) as claimed in claim 1, characterized in that the said tubular sleeve (26) of the said arm-ware (20) has opening areas at right side, left side and/or on top portion of arm ware (20) wherein the open areas may be shaped differently having variously shaped patterns.

6. The transformable arm-ware (20) as claimed in claim 1, characterized in that the said tubular sleeve (26) of the said arm-ware (20) has opening areas at right side, left side and/or on top portion of arm-ware (20) wherein the opening areas are shaped variously having different styles for exhibiting various designs engraved in appropriate portions of the forearm.

7. The transformable arm-ware (20) as claimed in claim 1, characterized in that the said second wing (50) comprises of additional fittings (48), in addition to the said four loops (51, 51', 52, 52') wherein the said additional fittings (48) are fitted to any of the user's fingers/thumb (46) and the said second wing (50) is utilized for various purposes wherein the user displays either side (47) of second wing (50).

8. The transformable arm-ware (20) as claimed in claim 1, characterized in that the said tubular sleeve (26) of the said arm-ware (20) is fully covered.

* * * * *